US009826815B2

(12) United States Patent
Pires et al.

(10) Patent No.: US 9,826,815 B2
(45) Date of Patent: Nov. 28, 2017

(54) APPLICATION DEVICE

(75) Inventors: Leo Clifford Pires, Basking Ridge, NJ (US); Roger Hwang, Maple (CA); Manisha Kohli, New Delhi (IN); Rahul Bose, New Delhi (IN); Smitaa Srivastava, New Delhi (IN)

(73) Assignee: ZEN DESIGN SOLUTIONS LIMITED, Kowloon, Hong Kong (CN)

( * ) Notice: Subject to any disclaimer, the term of this patent is extended or adjusted under 35 U.S.C. 154(b) by 952 days.

(21) Appl. No.: 13/184,445

(22) Filed: Jul. 15, 2011

(65) Prior Publication Data

US 2012/0014736 A1 Jan. 19, 2012

Related U.S. Application Data

(60) Provisional application No. 61/365,087, filed on Jul. 16, 2010.

(51) Int. Cl.
*B43K 27/08* (2006.01)
*A45D 40/24* (2006.01)

(52) U.S. Cl.
CPC ..... *A45D 40/24* (2013.01); *B43K 27/08* (2013.01)

(58) Field of Classification Search
CPC ..... B43K 27/08; B43K 27/00
USPC ..... 401/17, 22, 23, 34, 35
See application file for complete search history.

(56) References Cited

U.S. PATENT DOCUMENTS 3,887,287 A * 6/1975 Rosh, Jr. ..... B43K 27/08 401/198
4,974,980 A 12/1990 Gueret
5,017,034 A * 5/1991 Stary ..... B43K 7/005 401/17
5,306,092 A * 4/1994 Jenq ..... B43K 8/02 401/17
5,368,405 A * 11/1994 Sixiong ..... B43K 8/003 401/17
5,895,160 A * 4/1999 Ginelli ..... B43K 15/00 401/34
D462,989 S * 9/2002 Hung ..... D19/165
6,491,464 B1 * 12/2002 Young ..... B43K 27/04 401/17
6,554,517 B2 * 4/2003 Ahmed ..... 401/35
6,685,373 B1 * 2/2004 Liu ..... B43K 8/003 401/34

(Continued)

FOREIGN PATENT DOCUMENTS

WO WO 01/15912 A1 * 3/2001 ..... B43K 27/08

OTHER PUBLICATIONS

Nobuo, Matumoto; Machine translation of WO 01/15912 A1; retrieved on Nov. 9, 2016.*

*Primary Examiner* — Jennifer C Chiang
*Assistant Examiner* — Bradley Oliver
(74) *Attorney, Agent, or Firm* — Patterson + Sheridan, LLP

(57) ABSTRACT

An application device capable of applying at least two products either simultaneously or independently as per the requirement. The application device of the present invention comprises a cover, a gripping member and at least two applicators wherein the gripping member comprises of at least two receptacles for holding at least two products and the at least two applicators are in fluid communication with the at least two receptacles. The at least two applicators comprise of an applicator element wherein the applicator element may have a suitable shape such as but not limited to a tip.

17 Claims, 6 Drawing Sheets

(56) References Cited

U.S. PATENT DOCUMENTS

| | | | | |
|---|---|---|---|---|
| 7,077,592 | B2 | 7/2006 | Gueret | |
| 8,308,388 | B2 * | 11/2012 | Guay | A45D 34/04 401/198 |
| 2002/0076254 | A1 * | 6/2002 | Calabro | B43K 8/003 401/23 |
| 2005/0226675 | A1 * | 10/2005 | Kwan | B43K 27/08 401/35 |

* cited by examiner

APPLICATION DEVICE

CROSS REFERENCE TO RELATED APPLICATIONS

This application claims benefit of U.S. Provisional Patent Application No. 61/365,087, filed Jul. 16, 2011, which is incorporated by reference in its entirety.

BACKGROUND

Field of the Invention

The present invention generally relates to an application device. More particularly, the invention relates to an applicator device capable of applying at least two products either simultaneously or independently as per the requirement. The application device of the present invention comprises a cover, a gripping member and at least two applicators wherein the gripping member comprises of at least two receptacles for holding at least two products and the at least two applicators are in fluid communication with the at least two receptacles. The at least two applicators comprise of an applicator element wherein the applicator element may have a suitable shape such as but not limited to a tip.

The application device of the present invention may be used for cosmetic and care applications such as application on keratinous fibres, skin, nail, eyeliner application, lip liner application, mascara application, hair color application, etc.

Description of the Related Art

Traditionally, the eyeliner pencils are used to draw line on the eyelids to give user a dramatic look without much time and effort. The use of eyeliners makes eyes pop out by defining them and accentuating their shape. Also, various other types of applicator devices are known in the art for drawing lines on the eyelids.

U.S. Pat. No. 4,974,980 discloses an assembly including a liquid reservoir and an applicator equipped with at least one flexible, elastically deformable pen. The pen has a shape of a truncated cone and may be optionally flocked and thereby creating a surface suitable for retaining the product. The pen assembly is usable for applying any liquid make up product and in particular for applying eyeliners to the eyelids.

However, the usage of the disclosed pen applicator and other traditional eyeliner pencils are only able to apply one line of substance onto the skin of the user.

Also, there may be a need to make certain make up effects possible. It might be desired by the user to apply two or more lines of product onto the eyelids. In order to achieve the same, the user may use two different eyeliners in order to apply two lines of the product onto the eyelids, however in doing so the hand control of the user is generally not good enough to apply the second line of product at a uniform distance from the first line of product applied onto the eyelids.

In recent past, there have also been innovations done in the area of eyeliner applicators in order to apply two or more lines of product. U.S. Pat. No. 7,077,592 discloses an applicator device for applying a substance to the skin that may include an applicator element configured to apply at least one line of substance to the skin. The applicator element may further include a rod or a receptacle, a portion extending from the rod or receptacle, and at least two tips. Each of the tips may have fibers configured to retain the substance. The disclosed applicator device is able to apply one or more lines of product; however each line of product applied onto the eyelids is of the same product/color since the receptacle contains only a single color product. Further, it does not give the user an option to selectively apply from one tip or to mix the products being applied from the two tips.

Thus, if the product is applied using the aforementioned applicators then during the application one color eyeliner applicator would be subsequently followed by another color eyeliner applicator for application of two or more color line of product onto the eyelids.

It is therefore found by the inventors of the present invention that a single applicator device if capable of applying two or more color lines of product onto the eyelid results in the better application of the product and therefore the user is also provided with an even application of the product. Further, it is also desirable that the two color lines of the product have a substantially uniform distance between them upon application.

Therefore there exists a need in the art for a single applicator device that allows application of application of two or more lines of product of two or more different colors.

SUMMARY

The present invention generally relates to an application device. More particularly, the invention relates to an applicator device capable of applying at least two products either simultaneously or independently as per the requirement. The application device of the present invention comprises a cover, a gripping member and at least two applicators wherein the gripping member comprises of at least two receptacles for holding at least two products and the at least two applicators are in fluid communication with the at least two receptacles. The at least two applicators comprise of an applicator element wherein the applicator element may have a suitable shape such as but not limited to a tip.

According to an embodiment of the present invention the at least two receptacles may hold the two different colors of the same product or two different products. Further, the product flow to the applicators is either gravity assisted or is through the deformable receptacles. Further, the at least two applicators of the application device of the present invention may dispense the respective products either simultaneously or independently as per the requirement.

According to an embodiment of the present invention the applicator element of the at least two applicators may have identical or different shapes.

According to an embodiment of the present invention the applicator element of the at least two applicators may include fibers configured to retain the product and apply at least one line of product to the skin of the user upon application.

According to an embodiment of the present invention the applicator element of the at least two applicators may be configured in the form of a variety of shapes but not limited to such as rounded shape, planar shape, circular shape, fork shape, and the like.

According to another embodiment of the present invention the applicator element of the at least two applicators may be of same or different sizes and dimensions.

According to yet another embodiment of the present invention there is provided a gap between the at least two applicators in order to prevent mixing of the products being dispensed by the individual applicators. The gap is provided by means of a barrier in between the two applicators. The barrier between the two applicators is such that its height can be adjusted so as to enable the two applicator elements to make contact with each other to enable mixing or to stay apart and prevent contamination.

According to yet another embodiment of the invention the gap between the two applicator elements is kept sufficient enough such that the end portion of the two applicator elements may be optionally flocked over their entire periphery.

According to yet another embodiment of the present invention the at least two applicator elements may be kept close to each other by adjusting the height of the barrier such that there occurs mixing of the products which are being dispensed from said applicator elements.

In accordance with yet another embodiment of the present invention the at least two applicators may comprise of two different materials. Each applicator element may be partially or completely covered with the flocking and thereby providing better retention of the product onto the surface. The said applicator elements may also be made up of porous material such as felt or foam which might not be flocked. As an exemplary embodiment, the two applicator elements may comprise a flocked applicator element and a porous applicator element.

In accordance with yet another embodiment of the present invention the said at least two applicators may be configured to draw different type of lines which may be selected by the displacement orientation of the applicator over the skin. The line width of the product applied could also be varied by varying the pressure exerted against the skin with said applicator and thus the user is able to draw either a thinner or a thicker line.

In accordance with yet another embodiment of the present invention the said application device is capable of drawing at least a pair of lines and each of the line drawn may either be a narrow line or a broad line.

According to another embodiment of the present invention the said at least two receptacles may store at least two differently color products wherein said color products are combined or superimposed to achieve desired blending effect and thereby providing a tonal effect upon application onto the skin of the user.

According to another embodiment of the present invention the at least two applicators do not mix or contaminate the product stored in their respective reservoirs with their adjacent and/or adjoining applicator before and after the application of the product onto the skin of the user.

According to another embodiment of the present invention the at least two applicators may further comprise a channel which may be at least extending over at least the length of the applicator. The channel provided in each of said applicator may facilitate the feeding of the product onto the applicator element with the product stored in said receptacles while a line is being drawn.

In accordance with yet another embodiment of the present invention the at least two applicators may be coupled to the gripping member by any suitable means such as press fit, force fit, interference fit, or the like.

In accordance with yet another embodiment of the present invention the application device may be used for cosmetic and care applications such as for eyeliner application, lip liner application, mascara application, hair coloring application, nail enamel application tattoo pen etc.

These and further aspects which will be apparent to the expert of the art are attained by a cosmetic applicator in accordance with the main claim.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings.

Figure 1:
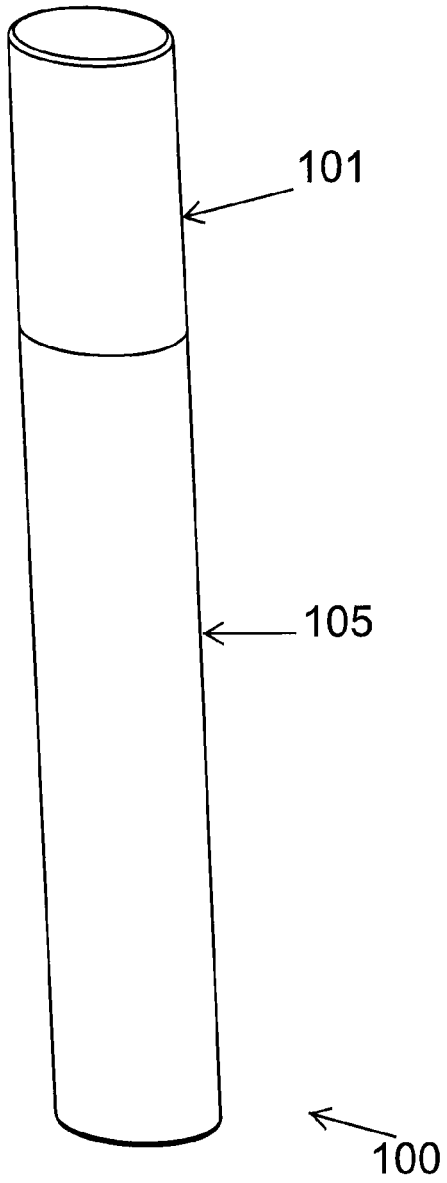
FIG. 1 illustrates an isometric view of the application device according to one embodiment of the invention.
Figure 2:
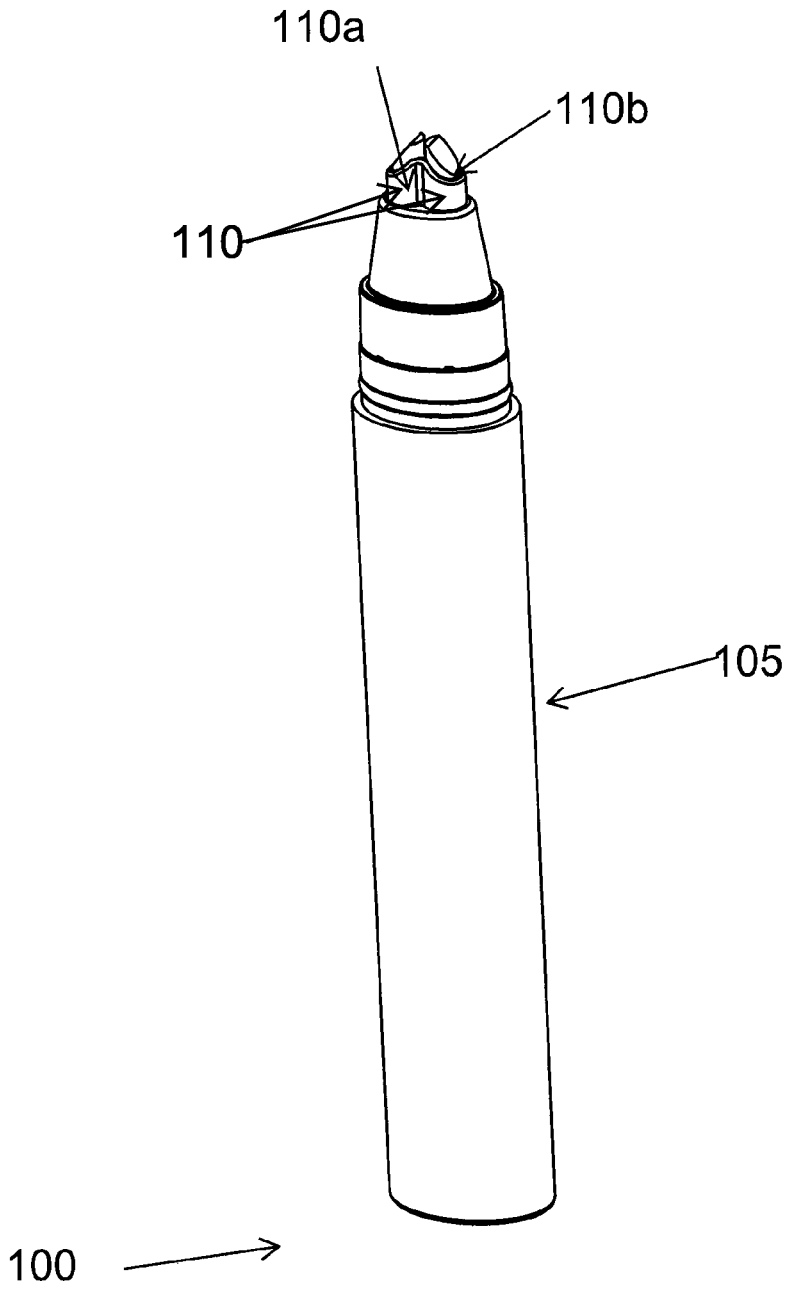
FIG. 2 illustrates the isometric view of the application device shown of FIG. 1 with the cover removed.
Figure 3:
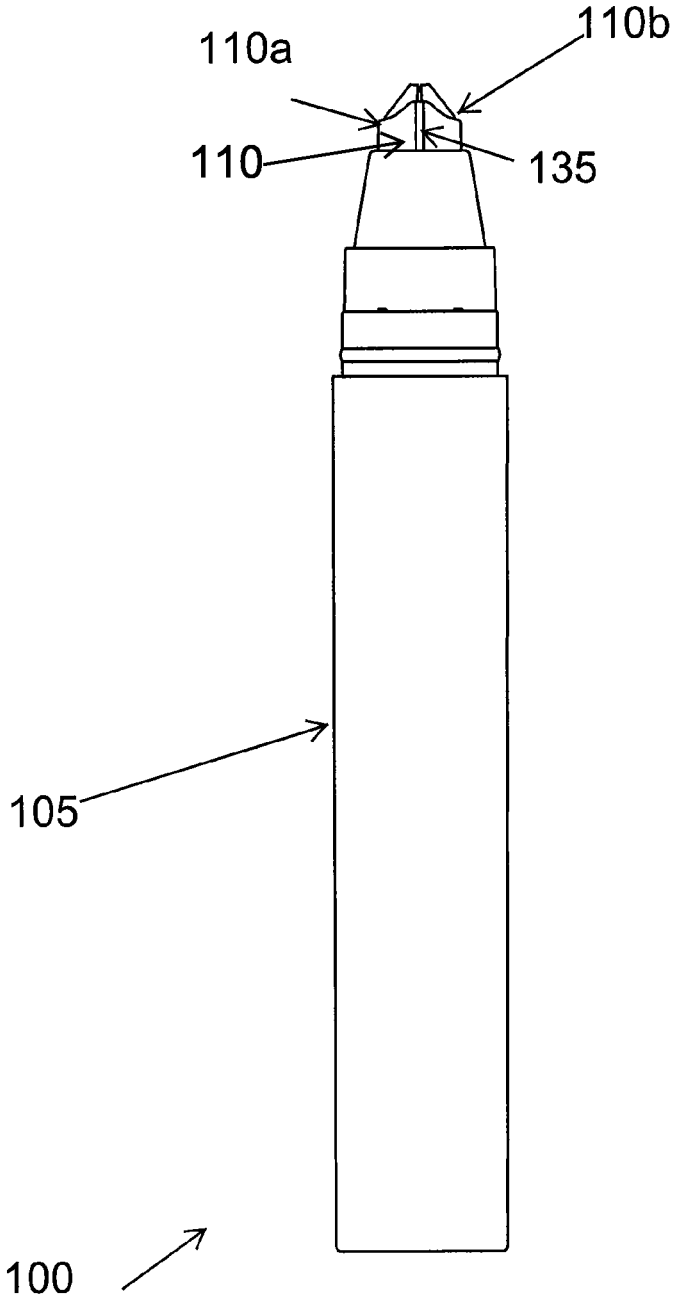
FIG. 3 illustrates the front view of the application device of FIG. 2.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

Figure 4:
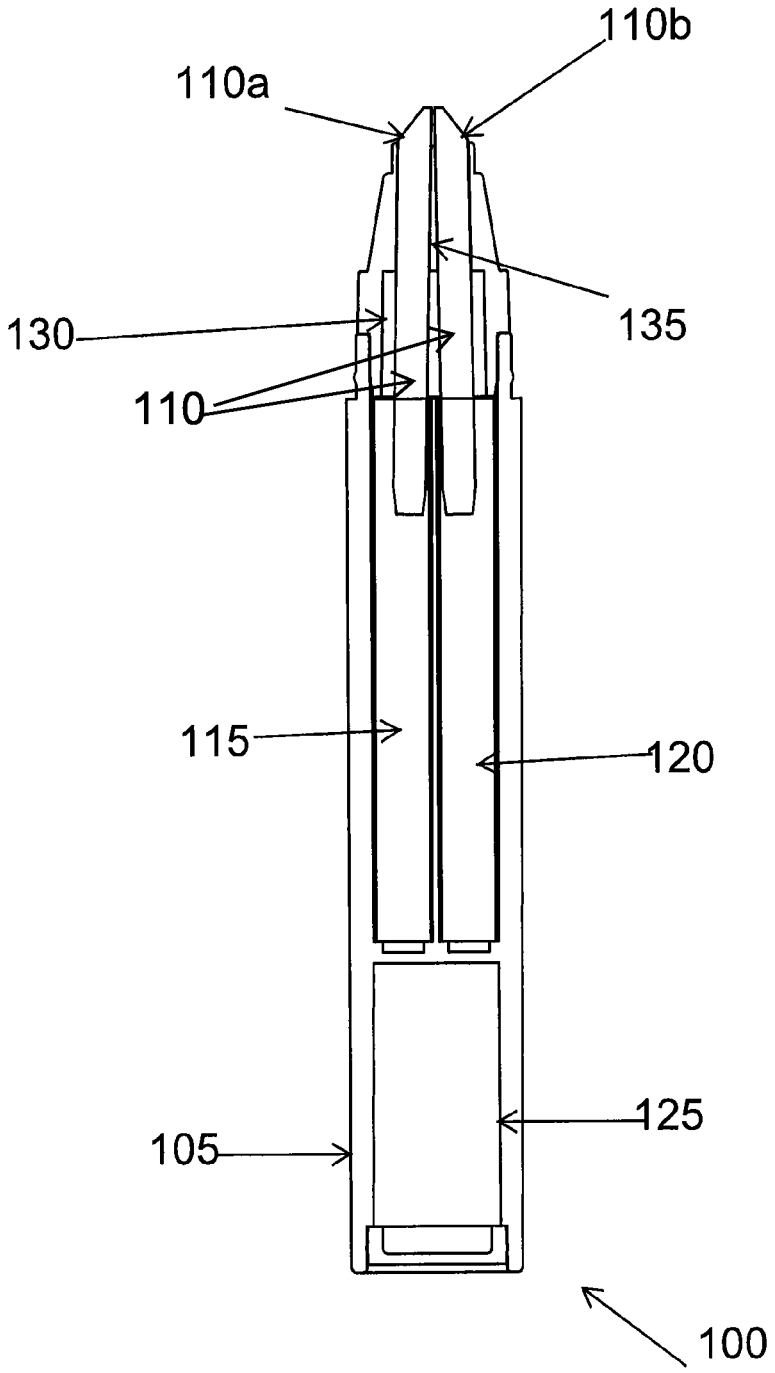
FIG. 4 illustrates the sectional view of the application device of FIG. 2.
Figure 5:
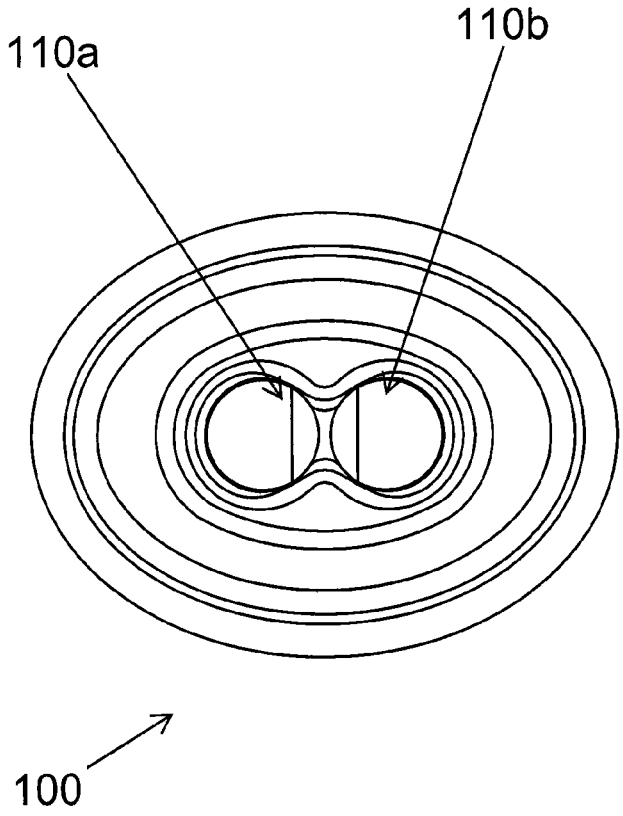
FIG. 5 illustrates a top view of the application device of FIG. 2.
Figure 6:
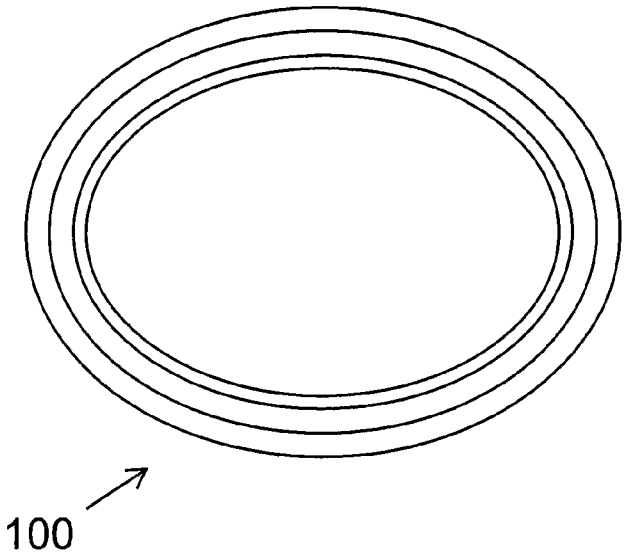
FIG. 6 illustrates a bottom view of the application device of FIG. 2.

FIG. 1 is one embodiment of the present invention showing an isometric view of the application device 100. As shown in FIGS. 1, 2, 3 and 4, the application device 100 comprises of a cover 101, a gripping member 105 and two applicators 110 for applying the products stored in the gripping member 105. As represented by FIG. 4, the gripping member 105 of the application device 100 comprises of two receptacles 115 and 120. Each of the said receptacles 115 and 120 are configured to contain a fluid/gel. The applicators 110 of the applicator device 100 are in fluid communication with the two receptacles 115 and 120 such that the product flow from the two receptacles 115 and 120 to the two applicators 110 is gravity assisted. Further, there is provided a space 125 in the gripping member 105 of the application device 100. The space 125 is used to hold extra applicators or another formulation such as a remover in the gripping member 105 of the applicator device 100. Further in the applicator device 100 there is provided a gap between the two applicators 110 by means of a barrier 135. The barrier 135 between the two applicators 110 is such that its height can be adjusted to either allow the applicators 110 to come in contact with each other or to keep apart from each other and prevent contamination.

The application device 100 of the present invention is further provided with a neck 130 at one end of the gripping member 105 for having said applicators 110 fixed thereto by any suitable means such as press fit, screw fit, interference fit, and the like. The neck 130 of the applicator device 100 can be made of a flexible material or a rigid material. Each of said applicators 110 is shown to comprise of applicator element in the form of an applicator tip 110*a* and 110*b*, and thereby able to apply two products onto the skin of the user. The receptacles 115 and 120 of the application device 100 may store a same product of different colors, or may store two different products.

Each of said applicator tip 110*a* and 110*b* of the said applicators 110 may be made up of different materials so as to give multiple effects in a single application. The different materials of the said applicator tips 110*a* and 110*b* may have properties that are attractive and non-attractive to the product stored in the receptacles 115 and 120, have different stiffness, have different tactile feel, have different color, have different chemical nature, have different magnetic property, have different temperature property and/or other property. Further, the applicator tips 110*a* and 110*b* of the said applicators 110 may be partially or completely covered with the flocking and thereby providing better retention of the product onto the surface, or the applicator tips 110*a* and 110*b* of said applicators 110 may also be made up of porous material such as felt or foam which might not be flocked. Further, the applicator tips 110*a* and 110*b* of the present invention may have any suitable shape, length, width/thickness and density.

Although the above description shows the application device 100 being cylindrical, the shapes and profiles cross section thereof are not limited to the same.

While the foregoing is directed to embodiments of the present invention, other and further embodiments of the invention may be devised without departing from the basic scope thereof, and the scope thereof is determined by the claims that follow. Accordingly, the appended claims should be construed to encompass not only those forms and embodiments of the invention specifically described above, but to such other forms and embodiments as may be devised by those skilled in the art without departing from its true spirit and scope.

What is claimed is:

1. An application device comprising:

a cover;

a gripping member; a neck attached to an end of the gripping member; and at least two applicators;

wherein the gripping member comprises of at least two receptacles for holding at least two products and wherein the at least two applicators are in fluid communication with the at least two receptacles;

wherein the at least two applicators are spaced apart by a barrier and wherein the barrier extends at least partially outside the neck such that the barrier is visible outside the neck between the at least two applicators;

wherein each of the at least two applicators has a single rectilinear central longitudinal axis extending along an entire length of the at least two applicators respectively;

wherein a distal portion of each of the at least two applicators comprises an applicator element;

wherein a proximal end of each of the at least two applicators has a centered frusto-conical shape;

wherein each of the at least two applicators is coupled to the neck of the gripping member such that the at least two applicator elements are mirror images of each other about a plane along a central longitudinal axis of the application device;

wherein the single rectilinear central longitudinal axis of each of the at least two applicators is at a non-zero angle to a central longitudinal axis of the respective at least two receptacles;

wherein the single rectilinear central longitudinal axis of one of the at least two applicators is non parallel to the single rectilinear central longitudinal axis of other of the at least two applicators throughout a length of the at least two applicators respectively; and wherein each of the at least two applicators is off-centered with respect to the central longitudinal axis of the respective at least two receptacles such that a portion of each of the at least two applicators located inside the respective at least two receptacles is closer to an inner surface of the respective at least two receptacles.

2. The application device according to claim 1 wherein the at least two applicators are coupled to the neck of the gripping member by an attachment selected from a group consisting of press fit, force fit, and interference fit.

3. The application device according to claim 1 wherein the at least two receptacles hold two different colors of the same product or two different products.

4. The application device according to claim 3 wherein the at least two receptacles store at least two differently color products wherein said color products are combined or superimposed to achieve desired blending effect and thereby providing a tonal effect upon application onto the skin of the user.

5. The application device according to claim 1 wherein the product flow from the at least two receptacles to the at least two applicators is gravity assisted.

6. The application device according to claim 5 wherein the at least two applicators dispense the respective products either simultaneously or independently.

7. The application device according to claim 1 wherein the applicator element of the at least two applicators include fibers configured to retain the product and apply at least one line of product to the skin of the user upon application.

8. The application device according to claim 1 wherein each of the at least two applicator elements is formed of a different material, and wherein each of the applicator element is either partially or completely covered with flocking and thereby providing better retention of the product onto the surface.

9. The application device according to claim 1 wherein the applicator elements are made up of a porous material selected from a group consisting of felt and foam.

10. The application device according to claim 1 wherein the two applicator elements comprise a flocked applicator element and a porous applicator element.

11. The application device according to claim 1 wherein the at least two applicators are configured to draw different type of lines which is selected by the displacement orientation of the applicator over the skin of the user.

12. The application device according to claim 1 wherein the line width of the product applied is varied by varying the pressure exerted against the skin with said applicator and thus the user is able to draw either a thinner or a thicker line, or a continuous/discontinuous line.

13. The application device according to claim 1 wherein the at least two applicators do not mix or contaminate the product stored in their respective reservoirs with their adjacent and/or adjoining applicator before and after the application of the product onto the skin of the user.

14. The application device according to claim 1 is used for cosmetic and care applications selected from a group consisting of eyeliner application, lip liner application, mascara application, hair coloring application, nail enamel application and tattoo pen.

15. An application device comprising:

a cover;

a gripping member; a neck attached to an end of the gripping member; and at least two applicators;

wherein the gripping member comprises of at least two receptacles for holding at least two products and wherein the at least two applicators are in fluid communication with the at least two receptacles;

wherein the at least two applicators are spaced apart by a barrier and wherein the barrier extends at least partially outside the neck such that the barrier is visible outside the neck between the at least two applicators;

wherein each of the at least two applicators has a rectilinear central longitudinal axis;

wherein a distal portion of each of the at least two applicators comprises an applicator element;

wherein a proximal end of each of the at least two applicators has a centered frusto-conical shape;

wherein each of the at least two applicators is coupled to the neck of the gripping member such that the at least two applicator elements are mirror images of each other about a plane along a central longitudinal axis of the application device;

wherein the rectilinear central longitudinal axis of each of the at least two applicators is at a non-zero angle to a central longitudinal axis of the respective at least two receptacles; and wherein each of the at least two applicators is off-centered with respect to the central longitudinal axis of the respective at least two receptacles such that a portion of each of the at least two applicators located inside the respective at least two receptacles is closer to an inner surface of the respective at least two receptacles; and wherein the barrier between the at least two applicators is such that a height of said barrier can be adjusted to enable the at least two applicator elements to make contact with each other to enable mixing or to stay apart and thereby prevent contamination.

16. An application device comprising:

a cover;

a gripping member; and at least two applicators;

wherein the at least two applicators are spaced apart by a barrier and wherein the gripping member comprises of at least two receptacles for holding at least two products and wherein the at least two applicators are in fluid communication with the at least two receptacles;

wherein each of the at least two applicators has a single rectilinear central longitudinal axis extending along an entire length of the at least two applicators respectively;

wherein a distal portion of each of the at least two applicators comprises an applicator element;

wherein each of the at least two applicators is coupled to a neck of the gripping member such that the at least two applicator elements are mirror images of each other about a plane along a central longitudinal axis of the application device;

wherein each of the applicator element comprises a top surface and an inclined side surface;

wherein the inclined side surfaces of adjacent applicator elements face away from each other and are inclined at similar angle with respect to the central longitudinal axis of the application device;

wherein the top surface of each of the at least two applicator elements is semicircular in shape and has a convex edge and a straight edge;

wherein the convex edges of the top surfaces of the at least two applicator elements face towards each other;

wherein the straight edges of the top surfaces of the at least two applicator elements are parallel to each other;

wherein the single rectilinear central longitudinal axis of each of the at least two applicators is at a non-zero angle to a central longitudinal axis of the respective at least two receptacles; and wherein each of the at least two applicators is off-centered with respect to the central longitudinal axis of the respective at least two receptacles such that a portion of each of the at least two applicators located inside the respective at least two receptacles is closer to an inner surface of the respective at least two receptacles.

17. The application device according to claim 16 wherein a portion of each of the at least two applicators located inside the respective at least two receptacles is closer to an inner surface of the respective at least two receptacles, wherein the inner surface lies closer to the central longitudinal axis of the application device.

* * * * *